US012440728B2

(12) United States Patent
Hollier et al.

(10) Patent No.: US 12,440,728 B2
(45) Date of Patent: Oct. 14, 2025

(54) ATHLETIC OR REHABILITATIVE FORCE REGISTERING DEVICE

(71) Applicants: Peter Alan Hollier, Norfolk (GB); Paul John Wade, Santa Rosa, CA (US); Jean Michaels, Aix-en-Provence (FR); Kurt Walter Tobias Hartmann, Manchester (GB)

(72) Inventors: Peter Alan Hollier, Norfolk (GB); Paul John Wade, Santa Rosa, CA (US); Jean Michaels, Aix-en-Provence (FR); Kurt Walter Tobias Hartmann, Manchester (GB)

( * ) Notice: Subject to any disclaimer, the term of this patent is extended or adjusted under 35 U.S.C. 154(b) by 178 days.

(21) Appl. No.: 17/768,573

(22) PCT Filed: Oct. 14, 2020

(86) PCT No.: PCT/GB2020/052575
§ 371 (c)(1),
(2) Date: Apr. 13, 2022

(87) PCT Pub. No.: WO2021/074615
PCT Pub. Date: Apr. 22, 2021

(65) Prior Publication Data

US 2024/0100393 A1 Mar. 28, 2024

(30) Foreign Application Priority Data

Oct. 14, 2019 (GB) ..... 1914798

(51) Int. Cl.
*A63B 24/00* (2006.01)
*A63B 21/00* (2006.01)
(Continued)

(52) U.S. Cl.
CPC .... *A63B 24/0062* (2013.01); *A63B 21/00185* (2013.01); *A63B 21/0442* (2013.01);
(Continued)

(58) Field of Classification Search
CPC ..... A63B 21/4034; A63B 21/4035; A63B 21/00185; A63B 21/0442; A63B 21/0553;
(Continued)

(56) References Cited

U.S. PATENT DOCUMENTS 2,467,943 A * 4/1949 Mikell, Jr. ..... A63B 23/085 482/79
3,117,781 A 1/1964 Vargo
(Continued)

FOREIGN PATENT DOCUMENTS

CH 703 458 A2 12/1978

OTHER PUBLICATIONS

International Search Report for International Patent Application No. PCT/GB2020/052575 mailed on Jan. 13, 2021 (2 pages).
(Continued)

*Primary Examiner* — Zachary T Moore
(74) *Attorney, Agent, or Firm* — Karthik Murthy; Murthy Patent Law Inc.

(57) ABSTRACT

A graspable handle which incorporates a force indicator with attachment to secure said device to provide resistance for purposes of exercise.

21 Claims, 5 Drawing Sheets

(51) Int. Cl.

| | |
|---|---|
| ***A63B 21/04*** | (2006.01) |
| ***A63B 21/055*** | (2006.01) |
| ***A63B 21/06*** | (2006.01) |
| ***A63B 71/06*** | (2006.01) |

(52) U.S. Cl.
CPC ..... *A63B 21/0552* (2013.01); *A63B 21/0609* (2013.01); *A63B 21/151* (2013.01); *A63B 21/4034* (2015.10); *A63B 21/4035* (2015.10); *A63B 71/0622* (2013.01); *A63B 2024/0068* (2013.01); *A63B 2071/0625* (2013.01); *A63B 2071/0658* (2013.01); *A63B 2220/51* (2013.01); *A63B 2220/58* (2013.01); *A63B 2220/833* (2013.01); *A63B 2225/09* (2013.01)

(58) Field of Classification Search
CPC ..... A63B 21/0609; A63B 21/151; A63B 21/0622; A63B 71/0622; A63B 2071/0625; A63B 2071/0658; A63B 2024/0068; A63B 24/0062; A63B 2220/51; A63B 2220/58; A63B 2220/833; A63B 2225/09

See application file for complete search history.

(56) References Cited

U.S. PATENT DOCUMENTS

| | | | | |
|---|---|---|---|---|
| 3,119,614 | A | 1/1964 | Berry | |
| 3,498,609 | A * | 3/1970 | Lukens | A63B 21/055 482/125 |
| 4,912,638 | A * | 3/1990 | Pratt, Jr. | A63B 21/4005 600/595 |
| 5,538,486 | A * | 7/1996 | France | A63B 21/4035 482/121 |
| 5,747,688 | A * | 5/1998 | Krementsov | A61B 5/224 73/379.01 |
| D778,374 | S | 2/2017 | Jaquish et al. | |
| 11,260,262 | B2 * | 3/2022 | Oltorik | A63B 21/4035 |
| 2002/0055424 | A1 * | 5/2002 | Brown | A63B 23/03533 482/91 |
| 2013/0005535 | A1 * | 1/2013 | Duchovne | A63B 21/00181 482/8 |
| 2017/0014662 | A1 * | 1/2017 | Piga | A63B 23/12 |
| 2019/0126097 | A1 * | 5/2019 | Thomson | A63F 13/816 |
| 2019/0290962 | A1 * | 9/2019 | Osbrink | A63B 24/0062 |

OTHER PUBLICATIONS

Written Opinion of the International Searching Authority for International Patent Application No. PCT/GB2020/052575 mailed on Jan. 13, 2021 (8 pages).

* cited by examiner

ATHLETIC OR REHABILITATIVE FORCE REGISTERING DEVICE

CROSS-REFERENCE TO RELATED APPLICATIONS

The present application is a continuation under 35 U.S.C. § 371 of International Application No. PCT/GB2020/052575, filed on Oct. 14, 2020, that claims priority to British Patent Application No. 1914798.2, filed on Oct. 14, 2019, the contents of which is incorporated herein by reference in its entirety.

TECHNICAL FIELD

The present invention relates to a device for measuring forces exerted for athletic or rehabilitative purposes, particularly a device designed to be portable.

BACKGROUND TO THE INVENTION

Devices designed to increase strength and endurance in the muscles are well known in the prior art. Perhaps the best known and most highly regarded tool for training the muscles is the barbell, the adjustable version of which was developed by Thomas Inch in the early 1900s. A highly simple device, the barbell comprises a long cylindrical handle, plus adjustable weights on either side. The barbell is considered the sine qua non of resistance training, by some experts. It is central to most strength sports (for example Olympic weightlifting and powerlifting) and can be found in virtually every commercial gymnasium in the world. Commercial barbell plates are weighted, giving coaches and athletes some information on the forces (in weight) they are expressing during training.

Barbells as tools also have deficiencies, however. Because the resistance they apply comes from gravity, a barbell with a comprehensive stack of weights is heavy, and reasonably large. This makes it unwieldy, inconvenient to travel with, and unsuitable for many modern living spaces. In addition, although barbells may be accurately weighted, it can be difficult or impossible for the athlete to know exactly how much force they are expressing against a barbell at some points during a technique; for example, a movement such as the top third of a curl will require the athlete to move the bar diagonally or even horizontally, which will require less force than the weight of the bar. Velocity and momentum are also difficult to account for.

Multiple devices can be found in the prior art which have been developed to eliminate one or both of these problems. One early solution to the problem of convenience was the chain-and-bar isometric device, promoted by Bob Hoffman in the 1950s. This device comprised a metal footplate attached to an adjustable length of chain, in turn attached to a bar-handle, not unlike a barbell, but unweighted. Some devices possessed one central chain, while others included twin chains attached to each end of the bar-handle. (A "footplate-attached to-bar-handle" device.) The athlete would stand upon the footplate and attempt to lift, curl or press the bar; due to being affixed to the chain and plate, the bar would not move, giving the athlete a solid isometric workout. U53117781 (A) (1964) discloses a variation of this device with cables designed to rotate around the bar-handle, in place of an adjustable length of chain. U53119614 (A) (1964) discloses a streamlined lightweight variation of this traditional device, with straps rather than an adjustable chain. Being relatively small and lightweight, all versions of this device were much more portable (and affordable) than a barbell set; unfortunately, it was impossible for coaches and athletes at the time to measure the forces they were using.

A more modern variation on this traditional device is disclosed in USD778374 (S). This device utilizes the same footplate and bar-handle of the old-fashioned isometric chain-and-bar device, but replaces the chain with elastic resistance bands. This device is portable and convenient, however it is still very difficult for the coach or athlete to know how much force is being expressed against the bar.

The prior art does contain examples of devices developed to register forces expressed on footplate-attached-to-bar-handle devices. By the beginning of the 1960s, these devices had been fitted with mechanical dynamometers to register force (as referenced in Alastair Murray's "Modern Weight Training", 1963, published by Nicholas Kaye Limited). These devices comprised a mechanical dynamometer typically attached between the footplate and chain of the device. This innovation allowed a coach or friend to see the force the athlete was expressing, however due to the location of the dynamometer directly below the athlete, the gauge was essentially invisible to the athlete themselves. This obviously posed a significant problem because, for athletes training alone, the force registering aspect of the device was useless.

The development of load cell and strain gauge technology, CPUs, and digital displays have potentially unlocked the possibility of eliminating this lingering issue of registering the force being used with tradition footplate-attached-to-bar-handle devices. Prior art contains multiple attempts to redevelop the fundamental, convenient, footplate-attached-to-bar-handle technology while eliminating the problem of a lack of force measurement. U52002055424 (A1) (2002) discloses a traditional footplate-attached-to-bar-handle device, with straps attached to load cells; the load cells are connected to an LED readout via a wire. CH703458 (A2) (2012) comprises the traditional chain-and-bar device, however includes load cell technology which registers the force being expressed against the bar-handle, plus an electronic display on the footplate which displays the force level.

These examples of prior art were designed to be solutions to the issue of force measurability in portable exercise equipment, however, these attempted solutions are imperfect. Cases where the digital display of force is located on the footplate pose a particular problem: because the athlete is standing above the footplate, manipulating the bar-handle, the display is underneath the athlete, in front of his or her feet, and will very likely become obscured by the bar-handle or the athlete's arms and hands. Where the digital display of force production is located outside the device—perhaps via a wire—the user has to find some way of securing the display; perhaps on a table or chair. This adds to the complexity of the procedure, and as before, in cases where the display is below the athlete's eyeline the display may well become obscured by the bar-handle or his or her arms during the exercise. Even where the display is potentially visible, it may be inadvisable to alter exercise form to view it, by twisting or bending the neck while holding heavy loads, etc., as this may cause a dangerous breakdown of proper exercise technique.

Thus, there exists a need for a portable device which measures and registers force during exercise, which indicates such force in a convenient and easily discernible manner to provide feedback to the user.

STATEMENT OF INVENTION

According to the present invention, there is provided an athletic or rehabilitative force registering device comprising:

a graspable handle incorporating an indicator configured to register and indicate forces, an attachment as a means to anchor or secure said handle to provide resistance; and a sensor configured to vary an electrical signal in response to a force applied thereto.

The present invention results from the recognition of the inventor that prior art electrical force registering resistance training equipment designed to be more portable and convenient than traditional "free weights" typically rely upon force indicators which must be set up separately from the resistance device, and/or are situated on the device below the upper limbs, and are as a result at risk of becoming obscured during exercise. The present invention, in contrast, is configured so that the force indicator is incorporated in the handle being grasped in the hands, and as a result is not subject to being obscured by the handle and upper limbs during the course of normal exercise. Being in closer proximity to the user, audio feedback from the force indicator will also be more clearly audible than a device set some further distance away. This invention requires the bespoke installation of a display and audio equipment inside the bar-handle, which is more complex than simply attaching pre-existing components, such as digital displays, separately.

Thus, the present invention is capable of measuring the forces applied by the athlete pushing or pulling against the bar-handle, when it is anchored via an attachment, and the athlete will be able to gain visual and/or audio feedback from the force indicator during training. He or she will know accurately what forces they are exerting during any point of an exercise. This feedback will in turn provide important coaching data as well as motivation. It is of key importance in resistance training to accurately ascertain performance variables to modify your training based upon your goals. Pushing or pulling against an anchored bar-handle without such feedback would be analogous to walking into a gymnasium and randomly lifting certain barbells, with no accurate idea of how much they weighed. It would be very difficult to make progress in such a fashion, and even if you did make progress you would be unable to quantify it.

Optionally, the sensor is contained in the graspable handle, the data from which sensor is transferred or transmitted to the indicator in the handle. Alternatively optionally, the sensor is contained in the attachment means, the data from which is transferred or transmitted to the indicator in the handle.

Conveniently, the indicator visually indicates the force level being expressed to provide an accurate indication of the force level being achieved.

Conveniently, the indicator audibly indicates the force level being expressed to enable the user to concentrate more fully on the exercise being undertaken.

Preferably, the indicator audibly indicates when a target level of force has been attained or exceeded. This allows the user to safely modify their use of the device, again without having to move their head or eyes to view a visual indicator.

Preferably, the indicator audibly indicates when a target level of force has been attained or exceeded, for a predetermined period of time, which enables a user to know they have achieved a pre-set target or to modify their use of the device.

Preferably, the indicator calculates, records and displays maximum forces attained during use. Optionally, the indicator calculates, records and displays average forces attained during use. Preferably, the indicator records training variables such as forces used, training time, volume, and calendar date. These features enable a user to keep a record of performance over time.

To provide an anchor and provide resistance, the attachment means preferably comprises a length of flexible material connecting the attachment means to a footplate. The flexibility of the material makes the device more portable, results in easy storage, and allows for pulling or pushing of the handle at a multitude of angles.

Preferably, the length of flexible material is centrally connected to the said handle. This allows for the use of just one set of sensor components.

Optionally, the length of flexible material comprises twin components or groups of components connected non-centrally to the said handle. This allows for the handle to be placed in alternative positions for different drills: for example, over the shoulders for squatting exercises.

Preferably, the length of flexible material is adjustable. This allows the user to perform various training drills with the handle at different heights.

Preferably, the length of flexible material is additionally connected to the footplate via a spring. The addition of the spring provides a certain active resistance against the forces used during exercise, mimicking a "live" load.

Preferably, the length of flexible material comprises one or more selected from a chain, elastic resistance band, a fabric rope, a webbing strap or a cable.

Preferably, the attachment means comprises a plurality of flexible lengths of material to increase the safety of the device and also allow materials of lower tensile strength to be used.

Preferably, the second flexible length of material comprises one or more selected from a chain, elastic resistance band, a fabric rope, a webbing strap or a cable.

Optionally, the sensor is a planar bending load cell secured to the graspable handle to provide a more accurate measure of the forces generated by a user.

Preferably, the location and/or angle of the indicator is adjustable relative to the handle to suit different exercises and users. This allows for easier viewing during exercises at different heights relative to the user.

DETAILED DESCRIPTION OF SPECIFIC EMBODIMENTS

Figures 1, 2:
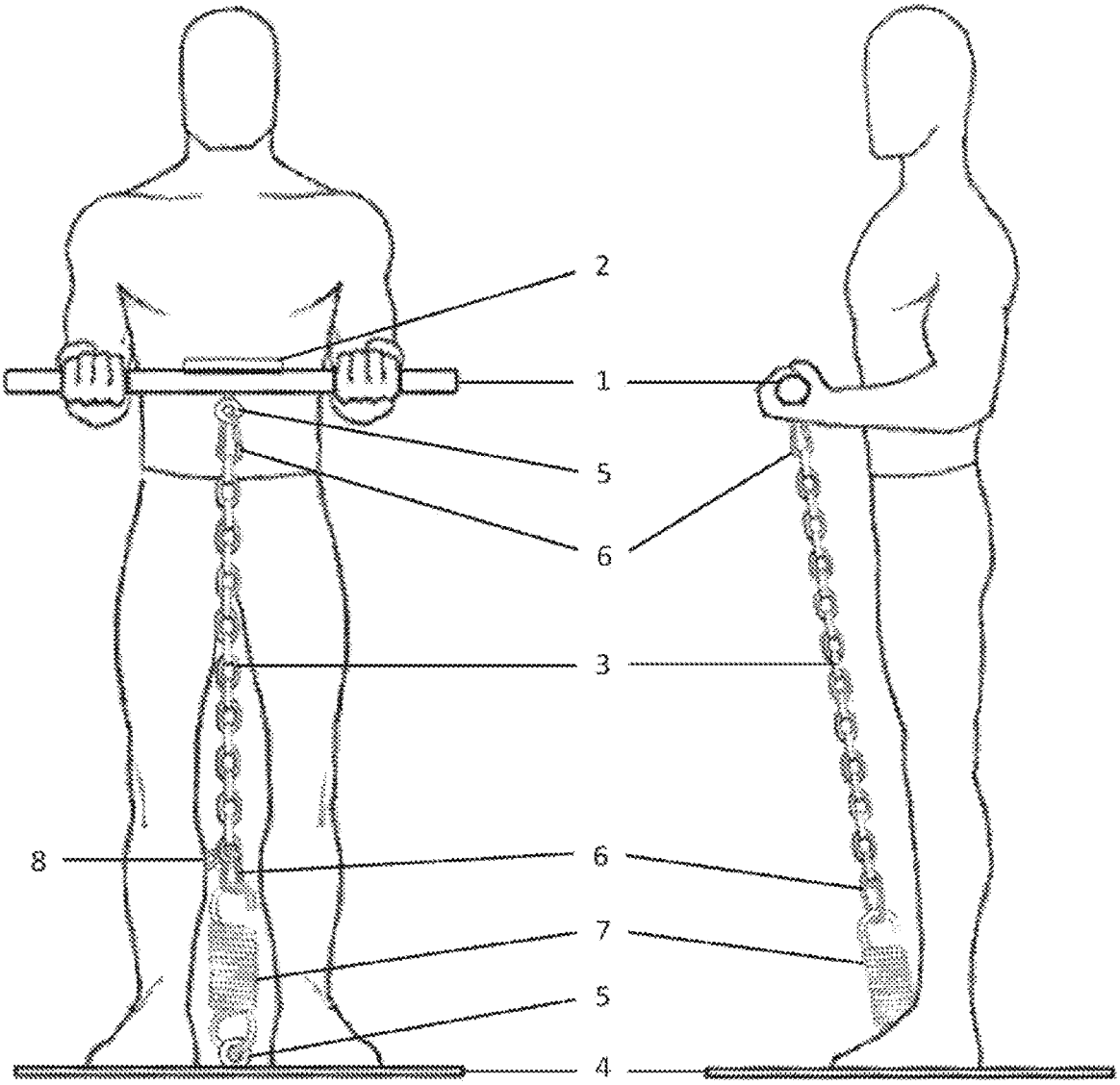
FIG. 1 is a rear view of the first embodiment of the present invention.
FIG. 2 is a side view of the first embodiment of the present invention.

FIG. 1 shows the first embodiment of the present invention. This is the preferred embodiment. The athletic force registering device comprises a graspable handle (1) incorporating an indicator (2) configured to register and indicate forces, also an attachment to anchor said handle and provide resistance, consisting of a length of flexible material, namely a chain (3), connecting to a footplate (4).

Connected to the bottom of the graspable handle is a central, vertical, metal loading ring (5). A carabiner, or snap-hook (6) attaches the loading ring to the top of the length of chain. The metal footplate has a vertical O-ring connected to it, near its centre. This is attached to the bottom end of a heavy-duty tension spring (7). The top end of the spring is in turn attached to another carabiner, which connects it to a lower point in the chain. Excess chain (8) is allowed to trail down onto the footplate. Optionally, the chain links may be numbered or alphabetised, to allow for precision length adjustments.

The indicator in the graspable handle indicates forces registered by a sensor within the handle which is configured to vary an electrical signal in response to the forces applied to the handle. The sensor itself is of a load cell type. There are various potential placements of such a load cell, all of which act as electrical transducers in response to deformation via external forces. For example, the sensor might comprise a planar bending load cell attached to the bar or a component of the bar. As the handle is pulled against the fixed chain, the bending moment of the load cell registers the force, with the load cell acting as an electrical transducer. Alternatively, a tension load cell can be attached between the handle and the loading ring; as the handle is pulled against the fixed chain, the deformation of the load cell registers the force, with the load cell acting as an electrical transducer. In either case, the resulting information is transmitted to, and calculated by, a CPU, and indicated on the indicator. The CPU also includes a tare calculation, to approximately remove the weight of the length of chain from the final feedback.

The presence of the carabiners allows the user to attach the lower or upper portion of chain to the spring or loading ring through various different links in the chain, thus adjusting the length of the usable chain. This allows the athlete to perform numerous isometric hold techniques at different heights; for example, deadlifts, various rows, shrugs, curls, front squats, presses, etc. In addition, the athlete can perform the same isometric drill at multiple points in the potential range-of-motion (for example, presses off the chest; presses at eye level; overhead press lockouts, etc).

The presence of the tension spring attached to the footplate allows the athlete some small amount of motive resistance during each drill, as the spring extends slightly under force. This is a step towards mimicking "live" loads. There is some anecdotal evidence that isometric holds which include this "live" (e.g., actively resisting) element engage a physiological "loading reflex" which relaxes cortical inhibition and results in a greater neurological recruitment of muscle fibres, and therefore, greater strength. Isometric exercises which lack this element of active resistance—such as pushing against a solid wall, for example—appear to recruit fewer fibres.

Given this embodiment, an athlete could stand on the footplate and push or pull the handle in a vertical plane with potentially large amounts of isometric force. The indicator would indicate these forces in real time, visually and via audio, giving feedback to the athlete. FIG. 2 depicts a side-view of an athlete performing an isometric curl drill. It can be seen from this drawing how the chain, spring and footplate act as an anchor to secure the handle and provide resistance.

The footplate in the preferred embodiment is metal, however in alternative embodiments it may be high density plastic, or any other durable material.

Figure 3:
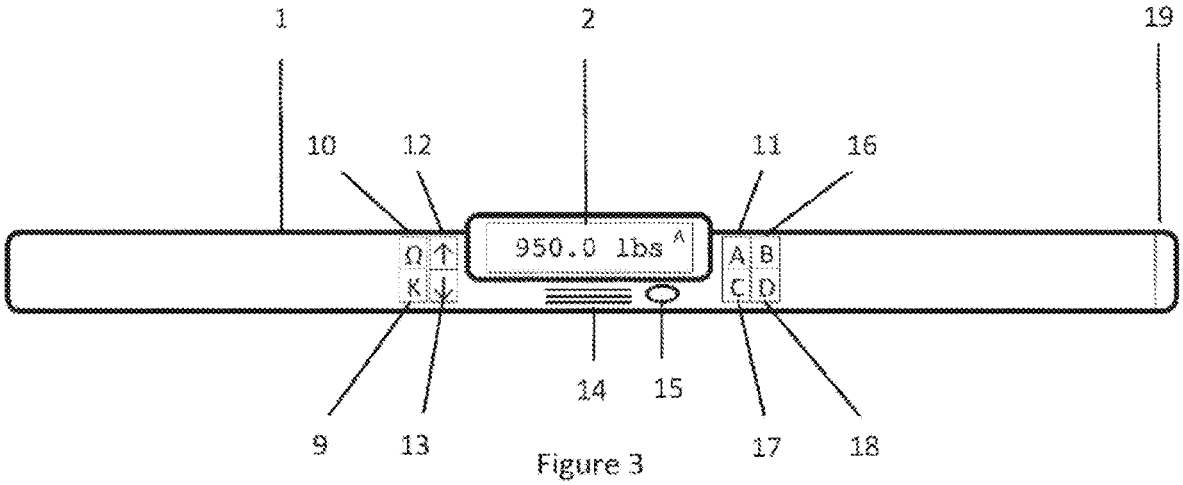
FIG. 3 is a top view of the handle portion of the first embodiment of the present invention.

FIG. 3 depicts the top view of the graspable handle (1) portion of the first embodiment of the present invention. The indicator (2) is present at the centre of the handle, for easy viewing. The digital indicator visually displays and auditorily indicates forces as weight, this being the traditional form of measurement in strength athletics. Weight can be toggled from pounds to metric via a weight selection button (9). A power on/off button is located centrally (10).

During use, the user can see force levels during their training fluctuate in real time via the indicator. This is the default function, if no other modes are selected. If a user wishes to enter a target force level (as weight) for a drill, they may select a "target-force mode" via a button (11). After this mode is selected, they use an up button (12) and a down button (13) to select a target force level (as weight). Near the centre of the handle, to prevent accidental coverage by the user's hands, a small speaker is located (14), as well as a volume on/off button (15). This small speaker is a component of the indicator. During "target-force mode", the speaker will beep, or buzz, or let off some audible noise to let the user know that they have reached or exceeded their target force level. In alternative embodiments, the speaker may indicate force levels using a speech program, or similar means.

Just as users can select a target force via a button, so they can select a customised target training time via the "timed mode" button (16). This sets a period of time for drills, anywhere from a second or so up to several minutes. After this mode is selected, the user presses the up button (12) and a down button (13) to select a target training time. When the user reaches their target force, the speaker will sound once every second, with the sound becoming higher each second: the final sound being prolonged to inform the athlete that the selected target training time has been met and his or her drill is completed. Modes which utilise the speaker for feedback are particularly useful for drills where the athlete cannot see the indicator (for example, during overhead presses). "Timed mode" also has the benefit that an athlete does not require an extra clock or timepiece to regulate their drills. Should the user not wish to customise training time, the indicator's default training time is set as six seconds, an ideal time for isometric holds, according to studies.

After any drill is completed, the athlete can press a button (17) to obtain a maximum force level achieved during the drill, or press a different button (18) to attain an average force level for the drill. Both of these values are calculated by the internal computer in the handle. The CPU can also store previous values, for review later. Any of these buttons can variously function as initiations or resets for new drills, or to access the CPU memory.

In alternative embodiments, the internal computer in the invention could transfer information to a computer, smart device or headphones, either via wires or wirelessly via Bluetooth, Wi-Fi, WAP, infrared, radio, or similar distance-based means of data transfer. This would allow the user to record and track or graph the forces in their training via software programs which would allow for more sophisticated data analysis. The receiving computer or smart device could even relate feedback, such as visual display of forces used, or audio feedback comprising various sounds or even numerical or vocalised feedback (statements of forces expressed, time target information, time remaining, or associated training variables). Similarly, target force, time, or other training variables could be inputted to the device via an external computer or smart device.

In the preferred embodiment, the handle also features a removable panel on the handle (19) for the insertion of batteries, but a wired utility plug for direct energy or recharging is equally viable. The wired plug could be detachable.

Figure 4:
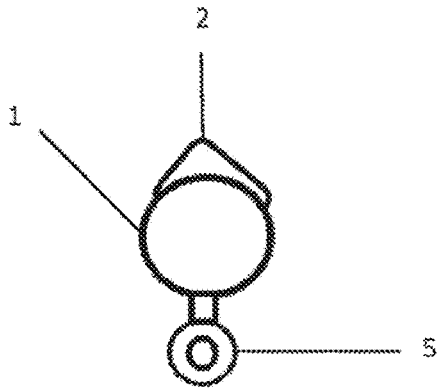
FIG. 4 is a side view of the handle portion of the first embodiment of the present invention.

FIG. 4 depicts the side view of the graspable handle (1) portion of the first embodiment of the present invention. Also visible is the loading ring (5) located directly below the top of the handle. (The carabiner/chain are not attached in this image.) The indicator (2) is located at the top of the handle. In this embodiment, the indicator is angled 45 degrees towards the user. A perfectly horizontal indicator, while easy to view while below eye-level (during exercises such as curls) would be impossible to see when the bar is at eye-level (during exercises such as presses). The angle of the indicator is optionally adjustable, and a milder angle would allow for visibility of the digital indicator at more variable relative heights.

In alternative embodiments, a central flexible attachment to anchor the handle to the footplate does not necessarily need to be a chain and spring combination. The attachment can be a chain, or chains, and can equally be a rope, cable, or webbing strap. These can be adjustable in length. The attachment can also be an elastic resistance band. Increased resistance can be achieved by adjusting the band, using a larger/denser band, or by using multiple bands. This latter embodiment would make the device capable of dynamic (i.e., moving) drills, the forces of which could all be registered in real time by the indicator. A geared mechanism with the cable/s threaded therethrough it can also be utilised to allow for dynamic movement. This latter design can be adjusted to make for different difficulty levels—lower or higher gears would require the user to apply a different force to the handle to move the cable through, etc.

In all alternative embodiments, the flexible attachment to anchor the handle to the footplate can be composed of various materials or combinations; elastic cables, webbing straps, ropes, chains, chains and springs, etc. Such attachments can include some kind of non-slip strap slider, buckle, latch, or related component to allow for a rapid adjustment of the length of the strap, to accommodate different training drills which require differing lengths of strap.

In all alternative embodiments, the flexible attachment can include a rotating ring or swivel joint, perhaps attached by links or carabiners, which would protect the loading ring (or rings) from excess torque when the attachment is placed under significant tension. Conversely, the loading ring (or rings) may be capable of revolving, to accommodate torque. Alternatively, the loading ring (or rings), or the sensor, may be capable of rotating or flexing in multiple directions, to accommodate various angles of force.

Figure 5:
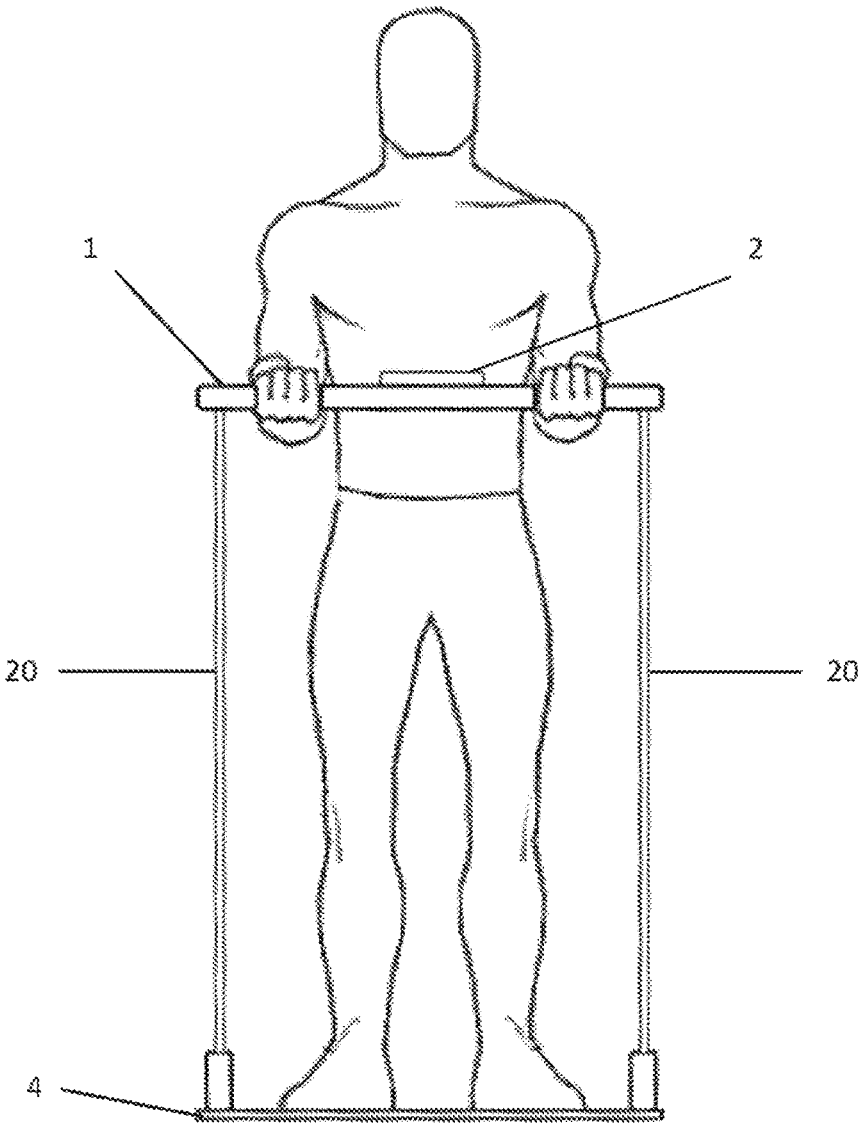
FIG. 5 is a rear view of the second embodiment of the present invention.

FIG. 5 depicts a second embodiment of the present invention, which illustrates that the attachment to anchor the handle to the footplate need not be singular and centrally located. In this embodiment, the flexible material attachment comprises twin components, in this case, elastic cables (20), one connected to either side of the handle (1) and footplate (4), respectively. In place of the preferred embodiment's central sensor, this embodiment can have twin sensors, load cells located either externally or internally at either end of the bar. The graspable handle (1) incorporates an indicator (2) configured to register and indicate forces. Again, in alternative embodiments the twin flexible attachments to anchor the handle to the footplate can be composed of various materials or combinations; elastic cables, webbing straps, ropes, chains, chains and springs, etc. These twin components can include some kind of non-slip strap slider, buckle, latch, or related component to allow for a rapid adjustment of the length of the strap, to accommodate different training drills which require differing lengths of strap. The twin components can also include a numbering or alphabetical system or marks or lines, to help the user adjust them to equal predetermined points.

Figure 6:
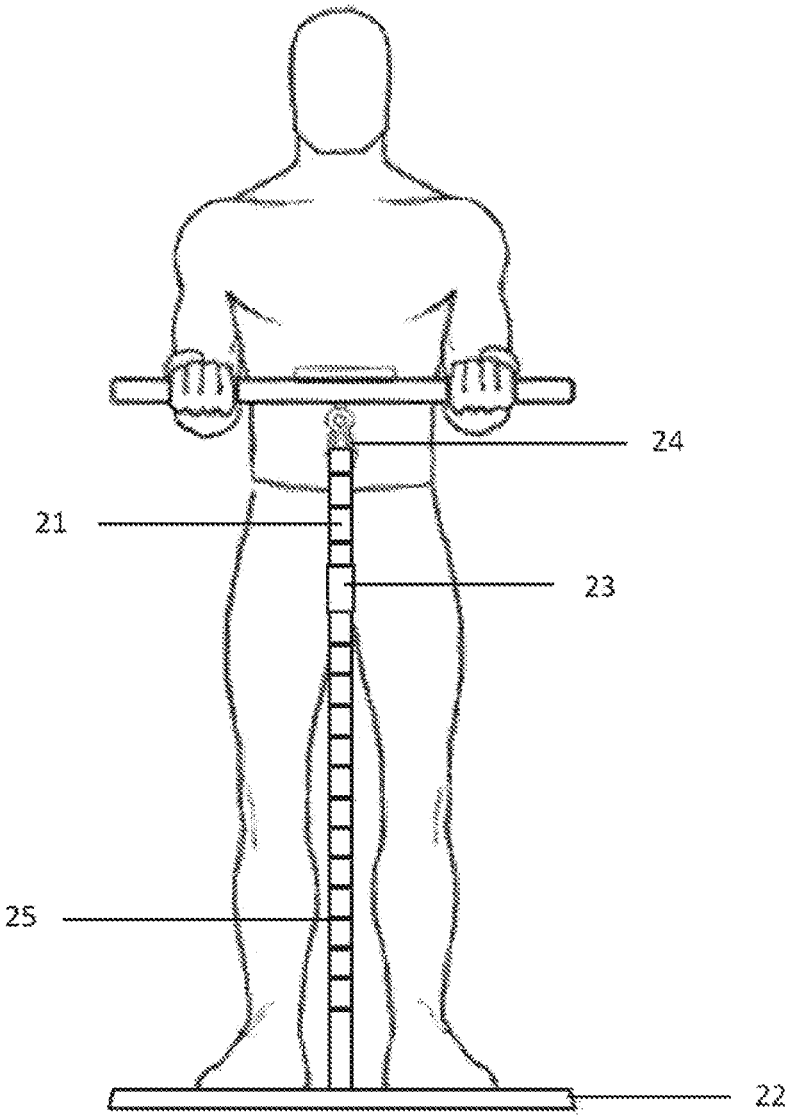
FIG. 6 is a rear view of the third embodiment of the present invention.

FIG. 6 depicts a third embodiment of the present invention, with differing materials used on the flexible material attachment and footplate. In this embodiment, the flexible attachment is formed from a length of strap (21). This strap can be synthetic webbing, or some similar light, strong, durable material. The footplate is comprised of high-density plastic (22). The webbing strap is doubled over to allow for the presence of a non-slip buckle (23), which allows the user to rapidly adjust the length of the webbing attachment to perform different drills. The top of the webbing loops through a triangle carabiner (24). Alternatively, could the top of the webbing can loop first through a rotating joint intended to reduce potential torque to the loading ring; in this case, a regular carabiner is required to attach the swivel joint to the loading ring. Equally, the strap can loop directly through a loading ring or loading rectangle large enough to accommodate the strap. The bottom of the webbing can loop down through twin slots in the footplate; down through one slot, under the footplate, then up through another. Alternatively, the slots can attach to a link connected to the footplate. The synthetic webbing has been marked with a series of numbered (or alphabetised) horizontal lines (25), which allow users to more precisely adjust the strap to the desired length. The mild elastic properties of the synthetic webbing material allow for a very slight "give" when under tension, and for this reason the embodiment does not require a spring attached to the footplate. Equally, a spring could be attached if so desired. Because of the lighter materials, this embodiment would be lighter and more portable than the primary embodiment.

Figure 7:
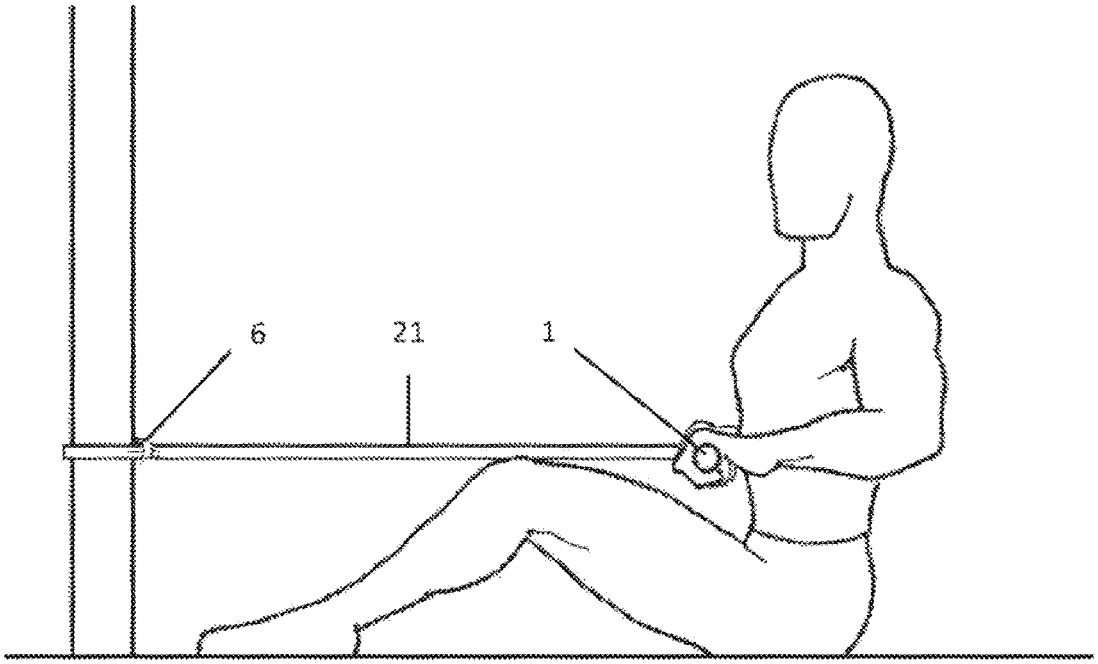
FIG. 7 is a side view of the third embodiment of the present invention.

FIG. 7 depicts a fourth embodiment of the present invention. The attachment to anchor the handle may not require a footplate if some alternative secure pre-existing external attachment point exists. In this embodiment the handle (1) is centrally connected to a length of strap (21). This strap could be nylon webbing, or some similar light, strong, durable material. This strap could include some kind of non-slip strap slider, buckle, latch, or related component to allow for rapid adjustments of the length of the strap, to accommodate different training drills which require differing lengths of strap. This strap (21) is wound around an external pole and connected to itself via a carabiner (6) or similar connector. An embodiment of device such as this can be secured to vertically deployed bases such as poles or columns, or to items on the ground, or to items on the ceiling or roof, such as rafters or horizontal bars, to provide different angles of resistance during exercises. The device can also be attached to planks or similar items to make ad hoc footplates. Note that the preferred embodiment can equally function in this manner by simply unclipping the lower carabiner from the tension spring. Once more, in alternative embodiments the central attachment may be composed of various materials or combinations; elastic cables, webbing straps, ropes, chains, chains and springs, etc.

In alternative embodiments, not illustrated, there is no requirement for the sensor to be connected to the handle, or internally located within the handle. A load cell or load cells may be located on or in the flexible attachment, where the footplate connects to the flexible attachment, or anywhere else along the line or lines of tension. The information provided by the sensor/s can be transmitted to the handle's CPU via wires, or wirelessly.

We claim:

1. A force registering device comprising:

a graspable handle incorporating an indicator configured to register and indicate forces;

an attachment as a means to anchor or secure said handle to provide resistance;

a sensor contained in the graspable handle configured to vary an electrical signal to the indicator in response to a force applied by a user thereto, wherein the data from the sensor is transferred or transmitted to the indicator in the handle;

wherein the indicator is positioned within the graspable portion of the handle such that the indicator remains within the direct line-of-sight of the user during isometric exertion, enabling real-time force feedback while exercising; and wherein said force registering device may be used in athletic or rehabilitative applications.

2. The force registering device according to claim 1, wherein the sensor is contained in the attachment means, the data from which is transferred or transmitted to the indicator in the handle.

3. The force registering device according to claim 1, wherein the indicator visually indicates a force level being expressed.

4. The force registering device according to claim 1, wherein the indicator audibly indicates a force level being expressed.

5. The force registering device according to claim 1, wherein the indicator audibly indicates when a target level of force has been attained or exceeded.

6. The force registering device according to claim 1, wherein the indicator audibly indicates when a target level of force has been attained or exceeded, for a predetermined period of time.

7. The force registering device according to claim 1, wherein the indicator calculates, records, and displays maximum forces attained during use.

8. The force registering device according to claim 1, wherein the indicator calculates, records, and displays average forces attained during use.

9. The force registering device according to claim 1, wherein the indicator records training variables of at least one of forces used, training time, volume, and calendar date.

10. The force registering device according to claim 1, wherein the attachment means is secured to a footplate.

11. The force registering device according to claim 1, wherein the attachment means comprises a length of flexible material.

12. The force registering device according to claim 11, wherein the length of flexible material is centrally connected to the said handle.

13. The force registering device according to claim 11, wherein the length of flexible material comprises twin components or groups of components connected non-centrally to the said handle.

14. The force registering device according to claim 11, wherein the length of flexible material is adjustable.

15. The force registering device according to claim 11, wherein the length of flexible material is additionally connected to a footplate via a spring.

16. The force registering device according to claim 11, wherein the length of flexible material comprises one or more materials selected from the group consisting of a chain, an elastic resistance band, a fabric rope, a webbing strap, a cable, and a combination thereof.

17. The force registering device according to claim 11, wherein the attachment means flexible length of material comprises a plurality of flexible lengths of material.

18. The force registering device according to claim 17, wherein the plurality of flexible lengths of material comprise one or more materials selected from the group consisting of a chain, an elastic resistance band, a fabric rope, a webbing strap, a cable, and combinations thereof.

19. The force registering device according to claim 1, wherein the sensor is a planar bending load cell secured to the graspable handle.

20. The force registering device according to claim 1, wherein a location and/or angle of the indicator is adjustable relative to the handle.

21. The force registering device according to claim 1, wherein the graspable handle is a bar handle.

* * * * *